US008618041B2

(12) United States Patent
Toussaint et al.

(10) Patent No.: US 8,618,041 B2
(45) Date of Patent: Dec. 31, 2013

(54) ALL-PURPOSE CLEANING COMPOSITIONS

(75) Inventors: Christine Toussaint, Aineffe (BE); Nicole Andries, Whihogne (BE); Myriam Mondin, Seraing Liege (BE)

(73) Assignee: Colgate-Palmolive Company, New York, NY (US)

( * ) Notice: Subject to any disclaimer, the term of this patent is extended or adjusted under 35 U.S.C. 154(b) by 445 days.

(21) Appl. No.: 12/994,364

(22) PCT Filed: May 26, 2009

(86) PCT No.: PCT/US2009/045146

§ 371 (c)(1), (2), (4) Date: Mar. 7, 2011

(87) PCT Pub. No.: WO2009/143510

PCT Pub. Date: Nov. 26, 2009

(65) Prior Publication Data

US 2011/0146709 A1 Jun. 23, 2011

Related U.S. Application Data

(60) Provisional application No. 61/055,504, filed on May 23, 2008.

(51) Int. Cl.
*C11D 1/72* (2006.01)

(52) U.S. Cl.
CPC ..... *C11D 1/72* (2013.01)
USPC ..... 510/421; 510/424

(58) Field of Classification Search
USPC ..... 510/421, 424
See application file for complete search history.

(56) References Cited

U.S. PATENT DOCUMENTS

| | | | | |
|---|---|---|---|---|
| 4,869,842 | A | 9/1989 | Denis et al. | |
| 5,350,541 | A | 9/1994 | Michael et al. | |
| 5,486,307 | A | 1/1996 | Misselyn et al. | |
| 5,534,184 | A * | 7/1996 | Underwood | 510/426 |
| 5,573,700 | A | 11/1996 | Steltenkamp et al. | |
| 5,703,033 | A * | 12/1997 | Sherry et al. | 510/237 |
| 5,716,925 | A | 2/1998 | Mondin et al. | |
| 6,057,279 | A * | 5/2000 | Mertens et al. | 510/417 |
| 6,194,370 | B1 * | 2/2001 | Williams et al. | 510/320 |
| 6,239,091 | B1 * | 5/2001 | Tartakovsky et al. | 510/220 |
| 6,303,556 | B1 * | 10/2001 | Kott et al. | 510/357 |
| 6,331,517 | B1 | 12/2001 | Durbut | |
| 6,346,508 | B1 | 2/2002 | Leonard et al. | |
| 6,362,148 | B1 * | 3/2002 | Durbut et al. | 510/238 |
| 8,282,743 | B2 * | 10/2012 | Bonnechere et al. | 134/25.2 |
| 8,367,595 | B2 * | 2/2013 | Cheung et al. | 510/191 |
| 2004/0204332 | A1 * | 10/2004 | Dastbaz et al. | 510/438 |
| 2005/0101510 | A1 * | 5/2005 | Mondin et al. | 510/475 |
| 2006/0100128 | A1 | 5/2006 | McCue et al. | |
| 2011/0271979 | A1 * | 11/2011 | Mondin et al. | 134/6 |

FOREIGN PATENT DOCUMENTS

| | | |
|---|---|---|
| CA | 2522249 | 10/2004 |
| EP | 0994180 | 4/2000 |
| WO | WO94/12599 | 6/1994 |

OTHER PUBLICATIONS

BASF Corporation, Technical Brochure, Improvements in Glass Cleaner Technology, 1992 (Sokalan.RTM.polymers in alkaline glass cleaners).

* cited by examiner

*Primary Examiner* — Gregory Webb

(74) *Attorney, Agent, or Firm* — Michael F. Morgan

(57) ABSTRACT

The present invention relates to surfactant-based all-purpose cleaners useful for cleaning surfaces including household hard surfaces as well as glass. The cleaning compositions comprise an anionic sulfonate surfactant, a non-ionic aliphatic ethoxylated surfactant, an alcohol, and a residue-reducing agent. The cleaning compositions of the invention are effective in removing soils such as grease soil and in leaving un-rinsed or unwiped surfaces residue free.

8 Claims, No Drawings

ALL-PURPOSE CLEANING COMPOSITIONS

CROSS REFERENCE TO RELATED APPLICATIONS

This application is a national stage entry under 35 U.S.C. §371 of International Patent Application No. PCT/US2009/045146, filed May 26, 2009, which claims priority to U.S. Application Ser. No. 61/055,504, filed on 23 May 2008, which is incorporated herein by reference.

BACKGROUND OF THE INVENTION

The present invention relates to surfactant-based all-purpose liquid cleaning compositions designed in particular for cleaning household hard surfaces as well as glass surfaces, which are effective in removing soils such as grease soil while also leaving un-rinsed or unwiped surfaces residue free.

In recent years liquid detergents have become widely accepted for cleaning hard surfaces, for example, painted woodwork and panels, tiled walls, wash bowls, bathtubs and other bathroom fixtures, linoleum or tile floors, or washable wall paper. Such "all-purpose" liquids may include clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts has generally been favored in currently known all-purpose liquids.

However, such currently known all-purpose liquid detergents containing detergent builder salts or other equivalents tend to leave films, spots or streaks on cleaned un-rinsed surfaces, particularly shiny surfaces. Thus, such liquids require thorough rinsing of the cleaned surfaces, which is a time-consuming chore for the user.

Consequently, there remains a need for all-purpose liquid cleaning compositions designed in particular for cleaning household hard surfaces as well as glass surfaces, which are both versatile and effective in removing soils such as grease soil, and also in leaving un-rinsed surfaces residue free, ideally with a shiny appearance.

BRIEF SUMMARY OF THE INVENTION

A non-emulsion cleaning composition comprising:

(i) about 0.1% to about 5%, or 0.2% to 2.5%, of an anionic sulfonate surfactant;

(ii) about 0.1% to about 5%, or 0.2% to 2%, of a non-ionic aliphatic ethoxylated surfactant;

(iii) about 0.1 to about 5% of an alcohol; and (iv) about 0.01% to about 2% of a residue-reducing agent.

A non-emulsion cleaning composition comprising:

(i) about 0.1% to about 5% of a $C_{10}$-$C_{14}$ linear alkyl sulfonate surfactant;

(ii) about 0.1% to about 5% of a non-ionic $C_9$-$C_{11}$ aliphatic ethoxylated surfactant;

(iii) about 0.1 to about 5% ethanol; and (iv) about 0.01% to about 2% of a maleic acid/olefin copolymer sodium salt.

DETAILED DESCRIPTION OF THE INVENTION

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Specifically, the invention relates to a household hard surface cleaner, which is not an emulsion, comprising an anionic sulfonate surfactant, a non-ionic aliphatic ethoxylated surfactant, an alcohol, and a residue-reducing agent. In various embodiments, the all-purpose cleaners of the invention may be effective in removing soils such as grease soil from surfaces such as hard surfaces (including household surfaces), and in leaving un-rinsed or unwiped surfaces free of residue, in various embodiments with a shiny appearance.

The present invention is directed, in certain embodiments, to an all-purpose liquid cleaning composition designed for cleaning household hard surfaces as well as glass surfaces and effective in removing grease soil and also in leaving un-rinsed or unwiped surfaces residue free, in various embodiments with a shiny appearance. In various embodiments, this composition comprises an anionic sulfonate surfactant, a non-ionic aliphatic ethoxylated surfactant, an alcohol, and a residue-reducing agent. In various embodiments, the composition further comprises an organic acid and water.

In certain embodiments, a cleaning composition of the present invention comprises about 0.1% to about 5%, of an anionic sulfonate surfactant, about 0.1% to about 5% of a non-ionic aliphatic ethoxylated surfactant, about 0.1% to about 5% of an alcohol, and about 0.01% to about 2% of a residue-reducing agent. In other embodiments, the amount of anionic sulfonate surfactant is 0.1, 0.2, 0.3, 0.4, 0.5, 0.6, 0.7, 0.8, 0.9, or 1 up to 2, 2.5, 3, 3.5, 4, 4.5, or 5%. In other embodiments, the amount of non-ionic aliphatic ethoxylated surfactant is 0.1, 0.2, 0.3, 0.4, 0.5, 0.6, 0.7, 0.8, 0.9, or 1 up to 2, 2.5, 3, 3.5, 4, 4.5, or 5%. In other embodiments, the amount of alcohol is 0.1, 0.2, 0.3, 0.4, 0.5, 0.6, 0.7, 0.8, 0.9, or 1 up to 2, 2.5, 3, 3.5, 4, 4.5, or 5%. In other embodiments, the amount of residue-reducing agent is 0.1, 0.2, 0.3, 0.4, 0.5, 0.6, 0.7, 0.8, 0.9, or 1 up to 1, 1.5, or 2%. In certain embodiments, the composition may further comprise about 0.01% to about 5% of an organic acid or 0.1, 0.2, 0.3, 0.4, 0.5, 0.6, 0.7, 0.8, 0.9, or 1 up to 2, 2.5, 3, 3.5, 4, 4.5, or 5% of the organic acid.

In certain embodiments, a cleaning composition of the present invention comprises about 0.1% to about 5%, or 0.2% to 2.5%, of a $C_{10}$-$C_{14}$ linear alkyl sulfonate surfactant, about 0.1% to about 5%, or 0.2% to 2% of a non-ionic $C_9$-$C_{11}$ aliphatic ethoxylated surfactant, about 0.1% to about 5% ethanol, and about 0.01% to about 2% of a maleic acid/olefin copolymer.

In certain embodiments, the present invention is directed to methods of removing soil from a surface, comprising the steps of applying a cleaning composition to the surface, and rinsing or wiping the surface, wherein the un-rinsed or unwiped parts of the surface are free of residue after the rinsing or wiping step.

In various embodiments, the present invention is directed to an all-purpose cleaning composition comprising:

(i) at least one anionic sulfonate surfactant, (ii) at least one non-ionic aliphatic ethoxylated surfactant, (iii) at least one alcohol solvent; and (iv) at least one residue-reducing agent.

Anionic Surfactants

The anionic sulfonate surfactants useful for the all-purpose cleaners of the present invention include water soluble anionic sulfonate surfactants and include, but are not limited to, sodium, potassium, ammonium, magnesium and ethanolammonium salts of linear $C_8$-$C_{16}$ alkyl benzene sulfonates; $C_{10}$-$C_{20}$ paraffin sulfonates, alpha olefin sulfonates containing 10 to 24 carbon atoms and $C_8$-$C_{18}$ alkyl sulfates and mixtures thereof. Examples of suitable sulfonated anionic surfactants include, but are not limited to, alkyl mononuclear aromatic sulfonates, such as the higher alkylbenzene sulfonates containing 9 to 18 or 9 to 16 carbon atoms, the higher alkyl group in a straight or branched chain, or $C_{8-15}$ alkyl toluene sulfonates and $C_8$-$C_{15}$ alkyl phenol sulfonates. In certain embodiments, the alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Illustrative materials are set forth in U.S. Pat. No. 3,320,174, especially those in which the alkyls are of 10 to 13 carbon atoms.

Other examples of suitable sulfonated anionic surfactants include, but are not limited to, those surface-active or detergent compounds, which contain an organic hydrophobic group containing generally 8 to 26 carbon atoms or 10 to 18 carbon atoms in their molecular structure and at least one water-solubilizing group selected from the group of sulfonate, sulfate and carboxylate so as to form a water-soluble detergent. Usually, the hydrophobic group will include a $C_8$-$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$-$C_3$ alkanolammonium. In an illustrative embodiment the cations are sodium, magnesium or ammonium cations.

Other suitable anionic surfactants include the olefin sulfonates, including long-chain alkene sulfonates, long-chain hydroxyalkane sulfonates or mixtures of alkene sulfonates and hydroxyalkane sulfonates; as well as paraffin sulfonates containing 10 to 20, or 13 to 17 carbon atoms.

In various embodiments, the anionic surfactant is present in an amount of about 0.01% to about 10%, about 0.1% to about 5%, about 0.01% to about 3%, about 1% to about 2% or about 1.5% of the cleaning composition.

Nonionic Surfactants

In certain embodiments, the compositions of the invention also comprise at least one water soluble aliphatic ethoxylated nonionic surfactant. Useful aliphatic ethoxylated nonionic surfactants include, for example, the primary aliphatic alcohol ethoxylates and secondary aliphatic alcohol ethoxylates. The length of the polyethenoxy chain can be adjusted to achieve the desired balance between the hydrophobic and hydrophilic elements.

In certain embodiments, the nonionic surfactant includes the condensation products of a higher alcohol (e.g., an alkanol containing 8 to 16 carbon atoms in a straight or branched chain configuration) condensed with about 4 to about 20 moles of ethylene oxide, for example, lauryl or myristyl alcohol condensed with about 16 moles of ethylene oxide (EO), tridecanol condensed with about 6 to about 15 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either about 6 moles of EC) per mole of total alcohol or about 9 moles of EO per mole of alcohol and tallow alcohol ethoxylates containing about 6 EO to about 11 EO per mole of alcohol.

In certain embodiments, the nonionic surfactants are the Neodol® ethoxylates (Shell Co.), which are higher aliphatic, primary alcohol containing about 9-15 carbon atoms, such as $C_9$-$C_{11}$ alkanol condensed with 4 to 10 moles of ethylene oxide (Neodol® 91-8 or Neodol 91-5). $C_{12-13}$ alkanol condensed with 6.5 moles ethylene oxide (Neodol® 23-6.5), $C_{12-15}$ alkanol condensed with 12 moles ethylene oxide (Neodol® 25-12), $C_{14-15}$ alkanol condensed with 13 moles ethylene oxide (Neodol® 45-13), and the like. Such ethoxamers generally have an HLB (hydrophobic lipophilic balance) value of about 8 to 15 and give good O/W emulsification, whereas ethoxamers with HLB values below 7 contain less than 4 ethyleneoxide groups and tend to be poor emulsifiers and poor detergents.

Additional water soluble alcohol ethylene oxide condensates contemplated by the present invention include, but are not limited to, the condensation products of a secondary aliphatic alcohol containing 8 to 18 carbon atoms in a straight or branched chain configuration condensed with about 5 to about 30 moles of ethylene oxide. Examples of commercially available nonionic detergents of the foregoing type include $C_{11}$-$C_{15}$ secondary alkanol condensed with either 9 EO (Tergitol® 15-S-9) or 12 EO (Tergitol® 15-S-12) marketed by Union Carbide.

In certain embodiments of the invention, the water soluble ethoxylated or propoxylated nonionic surfactants that may be useful also include aliphatic ethoxylated or propoxylated nonionic surfactants depicted by the formula:

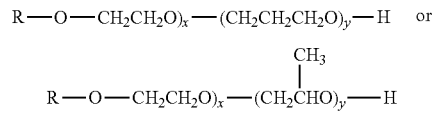

wherein R is a branched chain alkyl group having 10 to 16 carbon atoms, for example, an isotridecyl group, and x and y are independently numbered from 1 to 20. In certain embodiments, the ethoxylated or propoxylated nonionic surfactant is one that is available under, for example, the trade name Plurafac® 300 manufactured by BASF.

In various embodiments, the aliphatic ethoxylated nonionic surfactant is present in an amount of about 0.01% to about 10%, about 0.1% to about 5%, about 0.01% to about 3%, about 1% to about 2% or about 1% of the cleaning composition.

Alcohol

In various embodiments, the liquid cleaning compositions of the present invention comprise an alcohol. Useful alcohols may include, for example, methanol, ethanol, propanol, isopropanol, and derivatives thereof, and combinations thereof. Other alcohols suitable for use herein include diols or polyhydric alcohols such as glycerol; di-propylene glycol, polypropylene glycol, polyethylene glycol, butyl alcohol, butoxy-propoxy propanol, paraffin oil, 2 amino-2 methyl propanol, derivatives thereof, and combinations thereof.

In various embodiments, the alcohol may be present in an amount of about 0.01% to about 10%, about 0.1% to about 5%, about 0.01% to 3%, about 1% to 2%, or about 1% of the cleaning composition.

Residue-Reducing Agent

In various embodiments, the compositions of the present invention may also comprise a residue-reducing agent, which is an agent for reducing the amount of residue left on the surface being cleaned. Any agent known in the art for reducing the amount of residue can be used in the compositions of the present invention.

In certain embodiments, the residue-reducing agent may be a copolymer. The copolymer may be, for example, an olefin/maleic acid copolymer. In other embodiments, the residue-reducing agent may be a sodium salt of a $C_2$-$C_{10}$ olefin/maleic acid copolymer having a molecular weight of about 5,000 to about 15,000. In certain embodiments, the copolymer contains about 10% to about 90% of $C_2$-$C_{10}$ olefin monomer. Suitable olefin/maleic acid copolymers are available from, for example, BASF under the trade name SOKALAN CP 9 and Rohm and Haas under the trade name ACUSOL 420N and 480N.

In various embodiments, the residue-reducing agent may be present in an amount of about 0.01% to about 10%, about 0.1% to about 5%, about 0.01% to about 3%, about 1% to about 2%, or about 1% of the cleaning composition.

Optional Ingredients

The compositions of the present invention may include optional ingredients typically added to a cleaning composition, including fragrances, perfumes, preservatives, sequestering agents, dyes, colorants, solvents and organic acids such as citric acid or acetic acid and the like.

Optional ingredients that may be useful in the present compositions is a solvent, such as, e.g., glycol ether solvent. For example, useful solvents include those that have low solubility in water, such as, e.g., propylene glycol n-butyl ether, dipropylene glycol n-butyl ether, dipropylene glycol n-propyl ether, ethylene glycol n-hexyl ether and the like. When present, the total amount of solvent (which may include one or more solvents such as glycol ether solvent or mixtures) present may not be large enough to promote the formation of a microemulsion or emulsion composition.

Solubilizing agents such as ethanol, hexylene glycol, sodium chloride and/or sodium xylene or sodium xylene sulfonate may also be used to assist in solubilizing the surfactants in the cleaning compositions of the present invention. In certain embodiments, the viscosity of the cleaning compositions desirably will be similar to that of water.

In various embodiments, the pH of the compositions of the present invention is about 6 to about 10, about 6.5 to about 9.5 or about 7 to about 9. The pH of the compositions can be adjusted by the addition of agents such as acids (e.g., organic acids) or bases (e.g. $Na_2O$, caustic soda) to the compositions.

In various embodiments, the compositions of the present invention may comprise an optional organic acid, such as, for example, formic acid, acetic acid, lactic acid or combinations or derivatives thereof. For example, acetic acid, which is present in vinegar, may be present in an amount of, in various embodiments, about 0.01% to about 5%, about 0.05% to about 4% or about 0.1% to about 3% of the cleaning composition.

The compositions of the present invention have a wide number of usages in home care on hard surfaces like ceramic, varnished wood, vinyl, mirror, glasses, but also may be useful in fabric care, for example as prespotter on clothes or other fabric surfaces such as furniture or upholstery.

The following examples illustrate liquid cleaning compositions of the described invention. Unless otherwise specified, all percentages are by weight. The exemplified compositions are illustrative only and do no limit the scope of the invention. It will be understood by those of skill in the art that numerous and various modifications can be made without departing from the spirit of the present invention.

EXAMPLE 1

Table 1 illustrates an illustrative embodiment of an all-purpose cleaning composition of the invention (Composition A), which includes an alcohol and a residue-reducing agent.

TABLE 1

Illustrative Embodiment of an All-Purpose Cleaner of the Invention

| Ingredients | Composition A | Compartive |
|---|---|---|
| $C_{10}$-$C_{14}$ linear alkyl benzene sulfonate sodium | 1.5% | 1.5% |
| NI ($C_{12}$-$C_{14}$ Alcohol EO 7.5-8.1) | 1% | 1% |
| Alcohol (Ethanol) | 2% | 0 |
| Maleic Acid/Olefin Copolymer Na Salt | 0.25% | 0 |
| Minors, Water | to 100% | to 100% |

When the two compositions are used to clean glass panels and hard surfaces, Composition A provides a better grease cutting performance and leaves significantly reduced residues when compared to the comparative composition.

The all-purpose liquid cleaning compositions according to the present invention are designed in particular for cleaning household hard surfaces and glass surfaces, and are shown to be more effective in removing grease soil and in leaving un-rinsed surfaces with a shiny appearance when compared with known dilutable window cleaners and known all-purpose cleaners.

What is claimed is:

1. A non-emulsion cleaning composition comprising:

(i) 0.1% to 5% of a $C_{10}$-$C_{14}$ linear alkyl sulfonate surfactant;

(ii) 0.1% to 5% of a non-ionic $C_9$-$C_{11}$ aliphatic ethoxylated surfactant;

(iii) 0.1 to 5% of ethanol;

(iv) 0.01% to 2% of a maleic acid/olefin copolymer sodium salt; and (v) optional ingredients.

2. The composition of claim 1, further comprising an organic acid.

3. The composition of claim 1, wherein the acid is chosen from methanoic acid, propanoic acid, acetic acid or combinations or derivatives thereof.

4. The composition of claim 1 further comprising a surfactant is chosen from compounds of formulas:

$$R-O-(CH_2CH_2O)_x-(CH_2CH_2CH_2O)_y-H, \quad \text{and}$$

$$R-O-(CH_2CH_2O)_x-(CH_2\overset{\overset{CH_3}{|}}{C}HO)_y-H$$

wherein R is a linear or branched chain alkyl group having 8 to 16 carbon atoms, and x and y are independently numbered from 1 to 20.

5. The non-emulsion cleaning composition of claim 1 comprising:

(i) 0.2% to 2.5% of the $C_{10}$-$C_{14}$ linear alkyl sulfonate surfactant;

(ii) 0.2% to 2% of the non-ionic $C_9$-$C_{11}$ aliphatic ethoxylated surfactant;

(iii) 0.1 to 5% of the ethanol; and (iv) 0.01% to 2% of the maleic acid/olefin copolymer sodium salt.

6. The cleaning composition of claim 5, further comprising 0.01% to 3% of an organic acid chosen from methanoic acid, propanoic acid, acetic acid or combinations or derivatives thereof.

7. A method of removing soil from a surface, comprising the steps of applying a cleaning composition according to claim 1 to the surface, and rinsing or wiping the surface, wherein the un-rinsed or unwiped parts of the surface are free of residue after the rinsing or wiping step.

8. The cleaning composition of claim 5 comprising:

(i) 1.5% of the $C_{10}$-$C_{14}$ linear alkyl sulfonate surfactant;

(ii) 1% of the non-ionic $C_9$-$C_{11}$ aliphatic ethoxylated surfactant;

(iii) 2% of the ethanol; and (iv) 0.25% of the maleic acid/olefin copolymer sodium salt.

* * * * *